US008062065B2

(12) United States Patent
Whiteman, Jr. et al.

(10) Patent No.: US 8,062,065 B2
(45) Date of Patent: Nov. 22, 2011

(54) CONNECTOR ASSEMBLY HAVING A STABILIZER

(75) Inventors: Robert Neil Whiteman, Jr., Middletown, PA (US); Christopher David Ritter, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 27 days.

(21) Appl. No.: 12/559,672

(22) Filed: Sep. 15, 2009

(65) Prior Publication Data

US 2011/0065326 A1 Mar. 17, 2011

(51) Int. Cl.
*H01R 13/648* (2006.01)

(52) U.S. Cl. ..... 439/607.07

(58) Field of Classification Search ..... 439/607.07, 439/701, 79, 607.06, 607.068
See application file for complete search history.

(56) References Cited

U.S. PATENT DOCUMENTS

| | | | | |
|---|---|---|---|---|
| 6,299,484 | B2 * | 10/2001 | Van Woensel | 439/607.07 |
| 6,743,057 | B2 | 6/2004 | Davis et al. | |
| 6,749,468 | B2 | 6/2004 | Avery | |
| 6,780,069 | B2 | 8/2004 | Scherer et al. | |
| 7,270,574 | B1 * | 9/2007 | Ngo | 439/607.39 |
| 2009/0111298 | A1 * | 4/2009 | Stoner | 439/81 |

* cited by examiner

*Primary Examiner* — Phuong Dinh

(57) ABSTRACT

A connector assembly includes a housing extending along a housing axis between a front and a rear and contact modules loaded into the housing along the housing axis through the rear. The contact modules have a body holding contacts arranged along contact planes. A stabilizer is coupled to the housing and is coupled to the contact modules to hold the contact modules such that the contact planes are parallel to the housing axis.

20 Claims, 5 Drawing Sheets

CONNECTOR ASSEMBLY HAVING A STABILIZER

BACKGROUND OF THE INVENTION

The subject matter herein relates generally to connector assemblies, and more particularly, to connector assemblies having a plurality of contact modules.

Some electrical connector systems utilize electrical connectors to interconnect two circuit boards to one another, or to interconnect a data cable with a circuit board. One or more of the electrical connectors are mounted to a circuit board for mating with a corresponding electrical connector, which may be board mounted or cable mounted. In some high-density connector systems, the electrical connectors include a housing and a plurality of contact modules, sometimes referred to as chicklets, loaded into the housing. The contact modules include contacts with board mounting features, such as eye-of-the-needle portions, that may be terminated to the circuit board. The contacts have mating ends opposite the board mounting ends. Such electrical connectors are typically either right angle connectors with the mating ends and board mounting ends at right angles with respect to one another, or vertical connectors with the mating ends and board mounting ends at opposite ends of the contact modules.

With vertical connectors, the contacts typically pass straight through the contact modules between the opposite ends of the contact modules. The length of the contact modules, and thus the overall height of the mating interface of the vertical connector above the circuit board, may very depending on the particular application. For example, when additional height is needed to raise the mating interface further above the circuit board, such as when other components are mounted in proximity to the vertical connector, the contact modules may be relatively long. However, problems arise with vertical connectors having relatively long contact modules due to the distance between the housing and the board mounting end of the contact modules. For example, controlling the positions of the contact modules with respect to the housing and with respect to one another may become problematic. Such contact modules have an inherent lean caused by contact preload forces created during the assembly of the vertical connector. For example, when the contact modules are loaded in the housing, the mating ends of the contacts interfere with the housing which generally forces the contact modules to be angled with respect to the housing. A need remains for a connector assembly that is able to hold a true position of the contact models with respect to the housing.

BRIEF DESCRIPTION OF THE INVENTION

In one embodiment, a connector assembly is provided including a housing extending along a housing axis between a front and a rear and contact modules loaded into the housing along the housing axis through the rear. The contact modules have a body holding contacts arranged along contact planes. A stabilizer is coupled to the housing and is coupled to the contact modules to hold the contact modules such that the contact planes are parallel to the housing axis.

Optionally, the stabilizer may engage the housing in at least two different points, such that a front of the stabilizer is oriented perpendicular to the housing axis. The housing may include a chamber open at the rear that receives the contact modules and pockets positioned radially outward of the chamber. The pockets may be separated by separating walls therebetween, where fingers of the stabilizer are received in corresponding pockets such that the fingers engage the separating walls to position the stabilizer with respect to the housing. The stabilizer may hold the contact modules parallel to the housing axis against a preload force of the contact modules. Optionally, the stabilizer may include a planar plate extending between a front and a rear with tabs extending perpendicular from the plate at the rear and L-shaped fingers defined by a base and a leg extending perpendicular from the plate at the front. The leg may be slidably received within the pocket defined at a rear of the housing.

In another embodiment, a connector assembly is provided that includes a housing having a front and a rear with pockets at the rear. Contact modules are loaded into the housing through the rear. Portions of the contact modules extend rearward of the housing. The contact modules have a front and a rear with opposite sides and opposite ends extending between the front and rear. The contact modules are loaded into the housing such that the sides of adjacent contact modules face one another. The contact modules have mating contact extending from the front and mounting contacts extending from the rear. The mating contacts are loaded into the housing and the mounting contacts are configured to be mounted to a circuit board. A stabilizer is coupled to the housing and coupled to the contact modules to hold the contact modules relative to the housing. The stabilizer has tabs engaging the contact modules and fingers received in pockets of the housing.

DETAILED DESCRIPTION OF THE INVENTION

Figure 1:
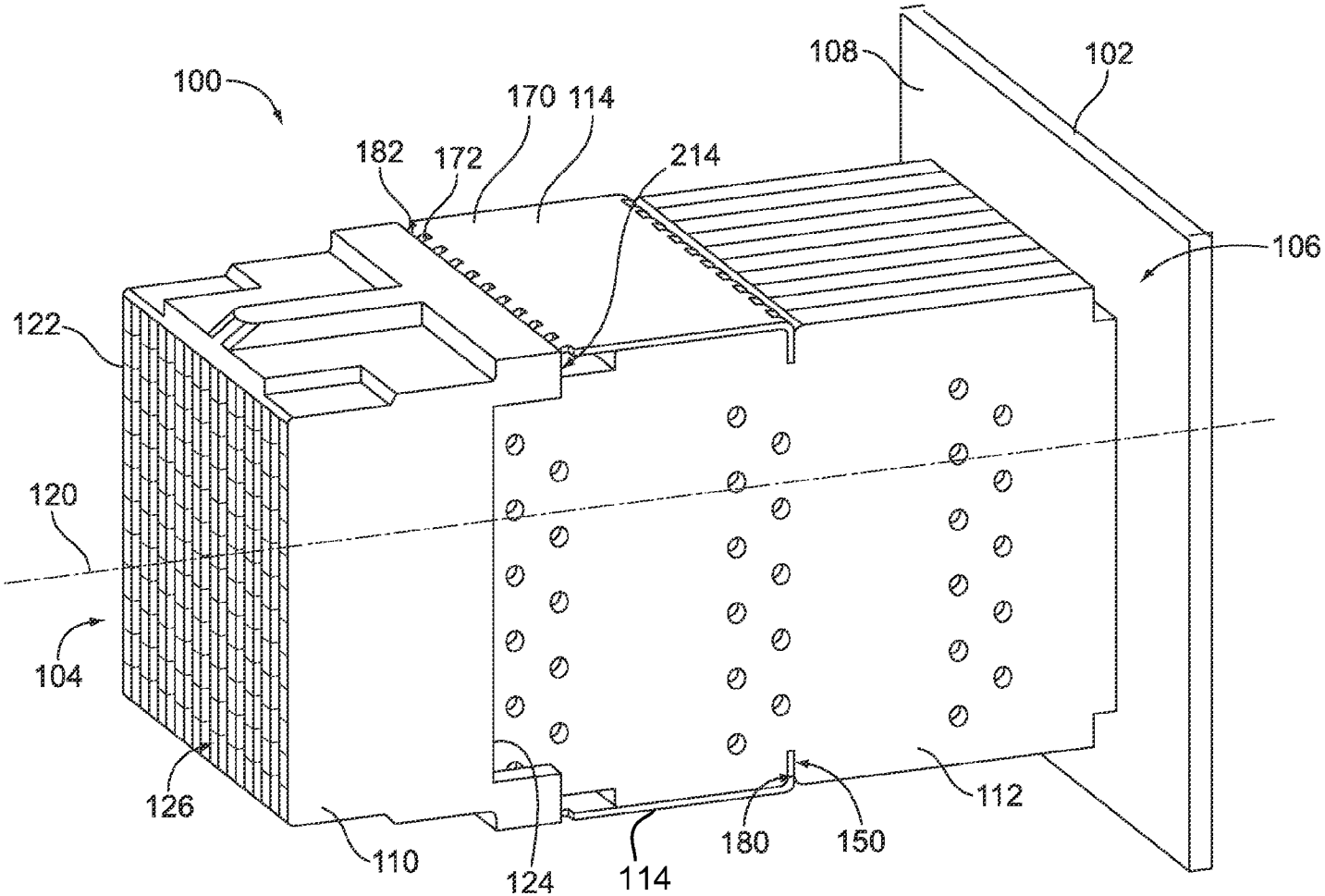
FIG. 1 is a perspective view of a connector assembly formed in accordance with an exemplary embodiment.

FIG. 1 is a perspective view of a connector assembly 100 formed in accordance with an exemplary embodiment. The connector assembly 100 is configured to be mounted to a circuit board 102. The connector assembly 100 includes a separable mating interface 104 and a non-separable mounting interface 106 that is mounted to a surface 108 of the circuit board 102. The connector assembly 100 is configured to mate with a mating connector (not shown) at the mating interface 104. The mating connector may be either board mounted or cable mounted. In an exemplary embodiment, the mating connector is a board mounted header connector configured to receive a portion of the connector assembly 100 therein.

In the illustrated embodiment, the connector assembly 100 constitutes a vertical connector assembly with the mating interface 104 positioned vertically above the surface 108 of the circuit board 102, which may be oriented generally horizontally. The circuit board 102 may be oriented differently (e.g. non-horizontally) in alternative embodiments, in which case the connector assembly 100 may represent another type of connector assembly other than a vertical connector assembly.

The mating interface 104 is oriented generally parallel to the mounting interface 106 and the surface 108. The mating interface 104 is positioned a distance from the mounting interface 106, which defines a height, such as a vertical height, of the connector assembly 100. For example, the mating and mounting interfaces 104, 106 may be oriented perpendicular to one another, defining a right angle connector.

The connector assembly 100 includes a housing 110, a plurality of contact modules 112 loaded into the housing 110, and a pair of stabilizers 114 coupled to the housing 110 and coupled to the contact modules 112. The connector assembly 100 may include more or less than two stabilizers 114 in alternative embodiments. The stabilizers 114 are used to hold the contact modules 112 in position with respect to the housing 110. The stabilizers 114 may be used to position the contact modules 112 with respect to the circuit board 102 such that the connector assembly 100 may be mounted to the circuit board 102. The stabilizers 114 are separate and distinct from both the housing 110 and the contact modules 112, and are coupled to the housing 110 and the contact modules 112 after the contact modules 112 are loaded in the housing 110.

The housing 110 extends along a housing axis 120 between a front 122 and a rear 124. The housing axis 120 is oriented generally perpendicular with respect to the surface 108 of the circuit board 102. The mating interface 104 is defined at the planer front 122 of the housing 110. The contact modules 112 are loaded into the housing 110 through the rear 124. The stabilizers 114 are coupled to the rear 124 of the housing 110. The housing 110 includes a plurality of contact cavities 126 open at the front 122. Contacts 128 (shown in FIG. 2) of the contact modules 112 are loaded into the contact cavities 126 when the contact modules 112 are loaded into the housing 110. Mating contacts (not shown) of the mating connector are also received in the contact cavities 126 for mating with the contacts 128. The contact cavities 126 are arranged in columns and rows, with any number of contact cavities 126 in each of the columns and each of the rows.

Figure 2:
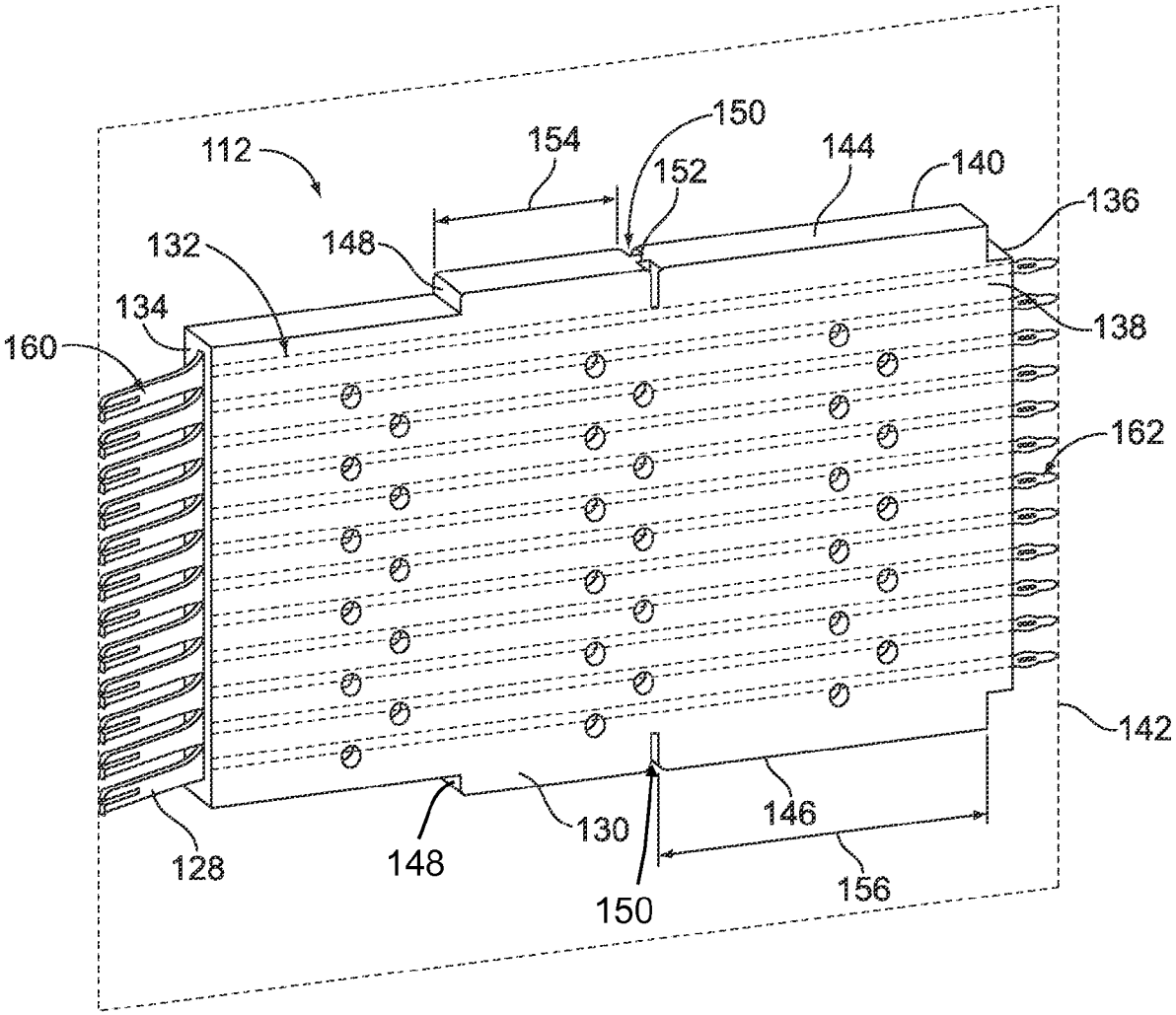
FIG. 2 illustrates a contact module for use with the connector assembly shown in FIG. 1.

FIG. 2 illustrates one of the contact modules 112 for use with the connector assembly 100 (shown in FIG. 1). Optionally, the contact modules 112 may be substantially identical to one another. Alternatively, different types of contact modules 112 may be used with the connector assembly 100. For example, two different types of contact modules 112 may be used in alternating sequence within the housing 110 (shown in FIG. 1).

The contact module 112 includes a dielectric body 130 that surrounds a lead frame 132 comprising a plurality of the contacts 128. The contacts 128 are manufactured from a common blank of stock metal material which is stamped or otherwise cut to form the individual contacts that may be electrically separate from one another. In some embodiments, the body 130 is manufactured using an over-molding process. During the overmolding process, the lead frame 132 is encased in a dielectric material, such as a plastic material, which forms the body 130. Optionally, the contact module 112 may be manufactured in stages that include more than one overmolding processes (e.g. an initial overmolding and a final overmolding). During the initial stages of manufacturing the contact module 112, the individual contacts 128 of the lead frame 132 are held together by a carrier or frame that is co-stamped with the contacts 128. The carrier is removed from the contacts 128 during, or after one of the overmolding processes, leaving the individual contacts 128 held by the body 130. In an alternative embodiment, individual contacts may be placed within the dielectric body 130 such that the contacts 128 are held by the body 130. The contacts 128 do not form part of a lead frame that is overmolded in such an embodiment.

The body 130 extends between a front mating end 134 and a rear mounting end 136. The body 130 includes opposed first and second generally planar sides 138, 140, respectively. The sides 138, 140 extend substantially parallel to and along the lead frame 132. The lead frame 132 defines a contact plane 142 between the sides 138, 140. The sides 138, 140 are generally parallel to the contact plane 142.

The body 130 includes opposed top and bottom ends 144, 146. The top and bottom ends 144, 146 extend between the sides 138, 140 and extend between the mating end 134 and the mounting end 136. In an exemplary embodiment, the top and bottom ends 144, 146 are stepped inward at the mating end 134 such that the body 102 is narrower at the mating end 134. Front shoulders 148 are defined at the top and bottom ends 144, 146 when the body 130 is stepped inward. The front shoulders 148 are forward facing. In alternative embodiments, the body 130 may not include steps, such that the top and bottom ends 144, 146 are generally planar.

The top and bottom ends 144, 146 include grooves 150 formed therein. The grooves 150 are open along the top and bottom ends 144, 146. The grooves 150 are also open along the sides 138, 140. Optionally, the grooves 150 may extend only partially between the sides 138, 140 such that a web 152 is positioned between a pair of the grooves 150 on both the top and bottom ends 144, 146. Alternatively, the grooves 150 may extend entirely between the sides 138, 140 such that no web 152 is provided. The grooves 150 are positioned a distance 154 from the front shoulders 148. The grooves 150 are positioned a distance 156 from the mounting end 136. The distance 154 is selected based on a length of the stabilizer 114 (shown in FIG. 1). The distance 156 is related to the overall length of the contact module 112.

The contacts 128 extend along the entire length of the contact module 112 between the mating end 134 and the mounting end 136. Portions of the contacts 128 extend from the mating end 134 and from the mounting end 136. For example, contact tips 160 extend from the mating end 134. Contact tails 162 extend from the mounting end 136. The contact tips 160 and contact tails 162 are defined during the overmolding process, wherein portions of the lead frame 132 are not overmolded by the body 130, but rather remain exposed.

The contact tips 160 are loaded into the contact cavities 126 (shown in FIG. 1) when the contact module 112 is loaded into the housing 110 for mating with the mating contacts. In an exemplary embodiment, the contact tips 160 are angled with respect to the contact plane 142. As such, the contact tips 160 are nonparallel with respect to the contact plane 142. When the contact tips 160 are loaded into the contact cavities 126, the contact tips 160 may interfere with the walls defining the contact cavities 126 such that the walls deflect the contact tips 160 from their normal resting position to a deflected position. Such deflection of the contact tips 160 causes a preload force in the contacts 128 when the contact tips 160 are loaded in the contact cavities 126.

The contact tails 162 extend from the mounting end 136 for mounting to the circuit board 102. For example, in the illustrated embodiment, the contact tails 162 represent eye-of-the-needle type contacts that are received in vias in the circuit board 102. The contact tails 162 may represent other types of contacts in alternative embodiments for mating with the circuit board 102.

Figure 3:
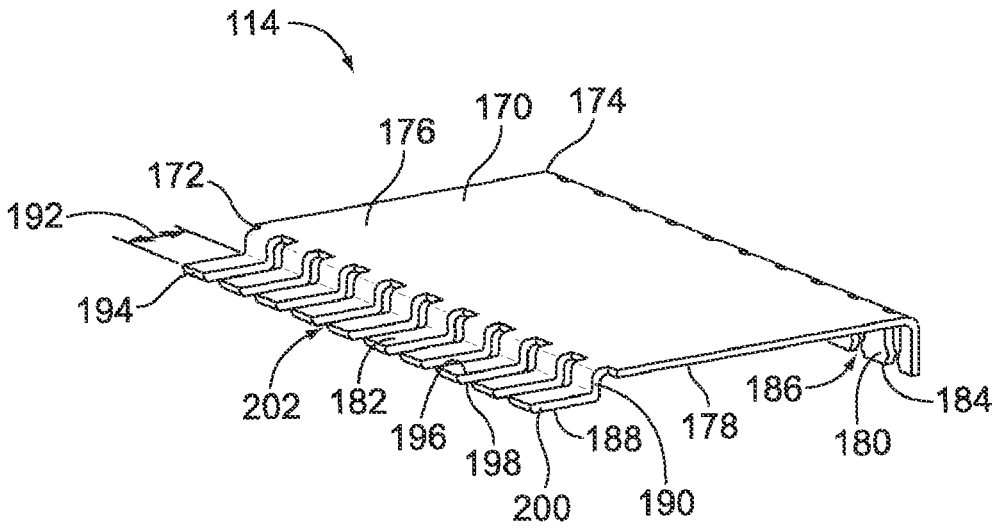
FIG. 3 is a perspective view of the stabilizer for the connector assembly shown in FIG. 1.

FIG. 3 is a perspective view of the stabilizer 114 for the connector assembly 100 (shown in FIG. 1). The stabilizer 114 is fabricated from a metal material that is stamped and formed. As such the stabilizer 114 may be manufactured in a cost-effective and reliable manner. The stabilizer 114 may be fabricated from other materials in alternative embodiments, such as a plastic material, or may be manufactured using a process other than stamping and forming.

The stabilizer 114 includes a plate 170 extending between a front 172 and a rear 174. The plate 170 has an outer surface 176 and an inner surface 178. Optionally, the plate 170 may be planar, however, in alternative embodiments, the plate 170 may be nonplanar, such as including one or more steps and/or features extending therefrom. The stabilizer 114 includes a plurality of tabs 180 extending from the plate 170 at the rear 174. The stabilizer 114 also includes a plurality of fingers 182 extending from the plate 170 at the front 172.

The tabs 180 extend generally perpendicular from the plate 170 in an inward direction from the inner surface 178 to a tab end 184. Gaps 186 are defined between each of the tabs 180. Optionally, the tabs 180 may have a bulbous shape at the tab ends 184. The bulbous shape is used to interfere with the contact modules 112 (shown in FIG. 2) when the stabilizer 114 is coupled to the contact modules 112.

The fingers 182 extend from the plate 170 in an inward direction from the inner surface 178. In the illustrated embodiment, the fingers 182 are L-shaped having a base 188 and a leg 190. The leg 190 is connected to the plate 170 and extends generally perpendicularly from the plate 170. The base 188 extends generally perpendicular from the leg 190 so that the base 188 is parallel to, and non-coplanar with, the plate 170. The base 188 extends forwardly from the leg 190. The base 188 has a length 192 measured from the leg 190 to a tip 194. The base 188 includes an outer surface 196 and an inner surface 198. The base 188 also includes sides 200. The fingers 182 are spaced apart from one another such that gaps 202 are defined between adjacent fingers 182. The sides 200 of adjacent fingers 182 are generally aligned with one another and face one another across the gaps 202.

Figure 4:
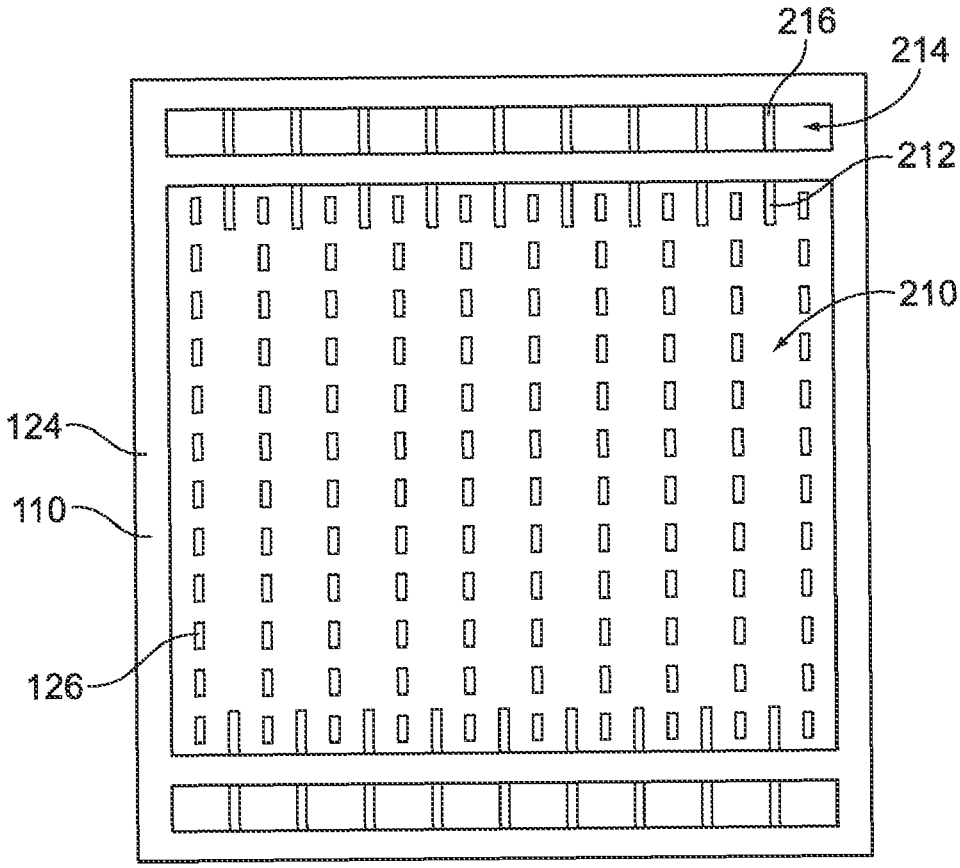
FIG. 4 is a rear view of a housing for the connector assembly shown in FIG. 1.

FIG. 4 is a rear view of the housing 110 for the connector assembly 100 (shown in FIG. 1). The housing 110 includes a chamber 210 open at the rear 124 that receives the contact modules 112 (shown in FIG. 1). The contact cavities 126 are exposed within the chamber 210 such that the contacts 128 (shown in FIG. 2) of the contact modules 112 may be loaded into the contact cavities 126 when the contact modules 112 are loaded into the chamber 210. In an exemplary embodiment, the housing 110 includes rails 212 that extend into the chamber 210. The rails 212 are used to guide the contact modules 112 into the housing 110. The rails 212 may be used to orient the contact modules 112 within the housing 110.

The housing 110 includes pockets 214 outward of the chamber 210. The pockets 214 receive the fingers 182 (shown in FIG. 3) of the stabilizer 114 (shown in FIG. 3). The pockets 214 are separated from one another by separating walls 216. When assembled, the separating walls 216 are received in the gaps 202 (shown in FIG. 3) between the fingers 182. In an exemplary embodiment, the sides 200 (shown in FIG. 3) of the fingers 182 engage the separating walls 216. For example, the width of the pockets 214 between the separating walls 216 is approximately equal to the width of the fingers 182 between the sides 200. As such, the fingers 182 may be securely held within the pockets 214.

Figure 5:
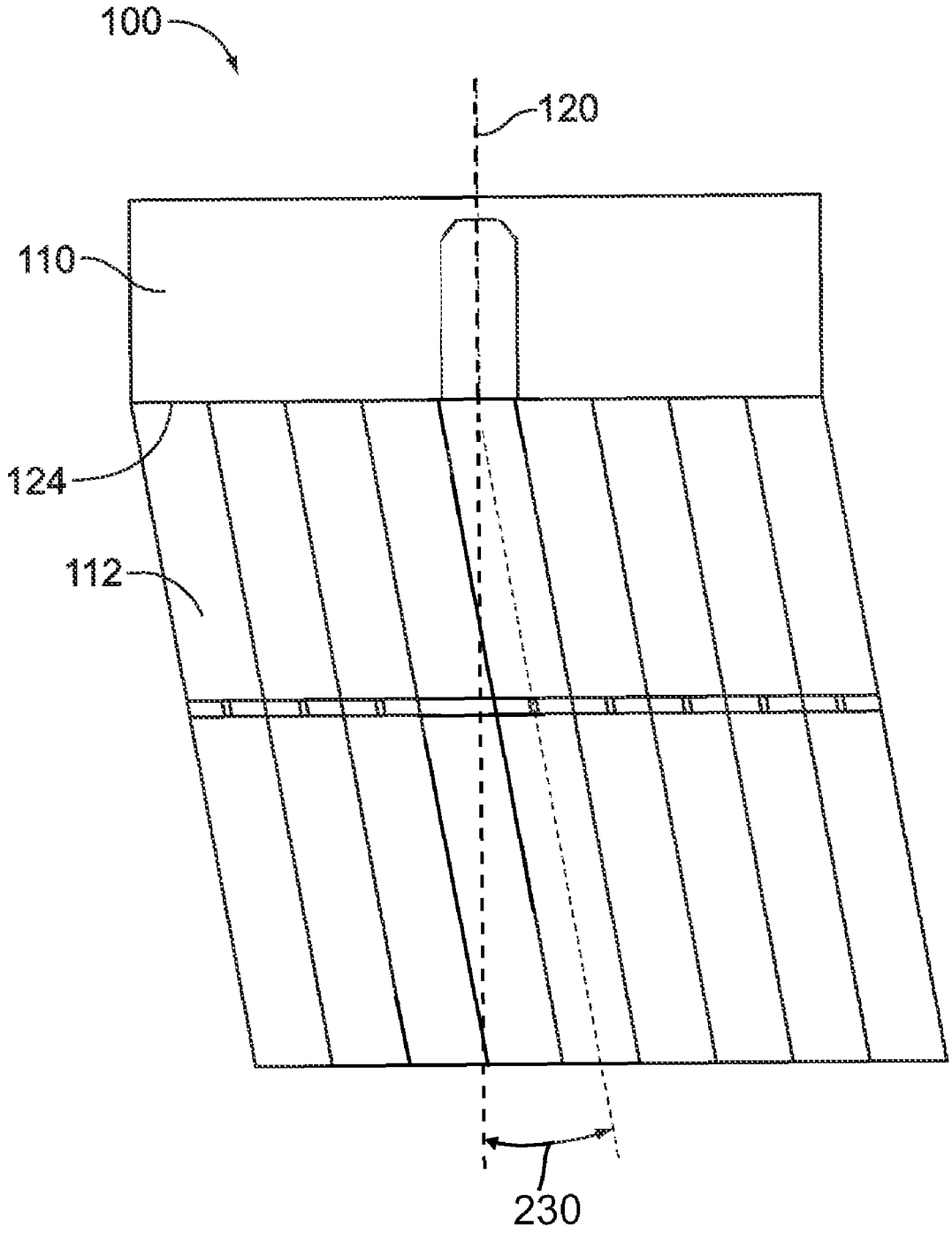
FIG. 5 is a top view of the connector assembly prior to the stabilizer being coupled to the housing and the contact modules.

FIG. 5 is a top view of the connector assembly 100 prior to the stabilizer 114 (shown in FIG. 3) being coupled to the housing 110 and the contact modules 112. The contact modules 112 are loaded through the rear 124 of the housing 110 generally along the housing axis 120. As noted above, when the contacts 128 (shown in FIG. 2) are loaded into the contact cavities 126 (shown in FIG. 4), the contacts 128 are preloaded against the walls of the contact cavities 126. For example, the contacts 128 may be flexed, causing a preload force in the contacts 128. The preload force places inherent stresses on the whole contact 128 shifting the contact modules 112, both within and outside of the housing 110, from the desired position. Such preload force tends to shift the contact modules 112 with respect to the housing 110. For example, the contact modules 112 tend to shift into alignment with the contact tips 160 (shown in FIG. 2) of the contacts 128. The rails 212 (shown in FIG. 4) may not be able to hold the contact modules 112 against the preload force.

When assembled, prior to coupling the stabilizer 114 to the housing 110 and the contact modules 112, the contact modules 112 may be angled at a skew angle 230 with respect to the housing axis 120. Furthermore, because each of the contact modules 112 are preloaded in the same direction, the amount of skew may be exaggerated. Additionally, depending on the length of the contact modules 112, the amount of skew may be intolerable. For example, the skew may cause problems with mounting the connector assembly 100 to the circuit board 102 (shown in FIG. 1). The skew may cause problems with the connector assembly 100 interfering with other components adjacent to the connector assembly 100 on the circuit board 102. The skew may cause problems with mating the connector assembly 100 with the mating connector.

Figure 6:
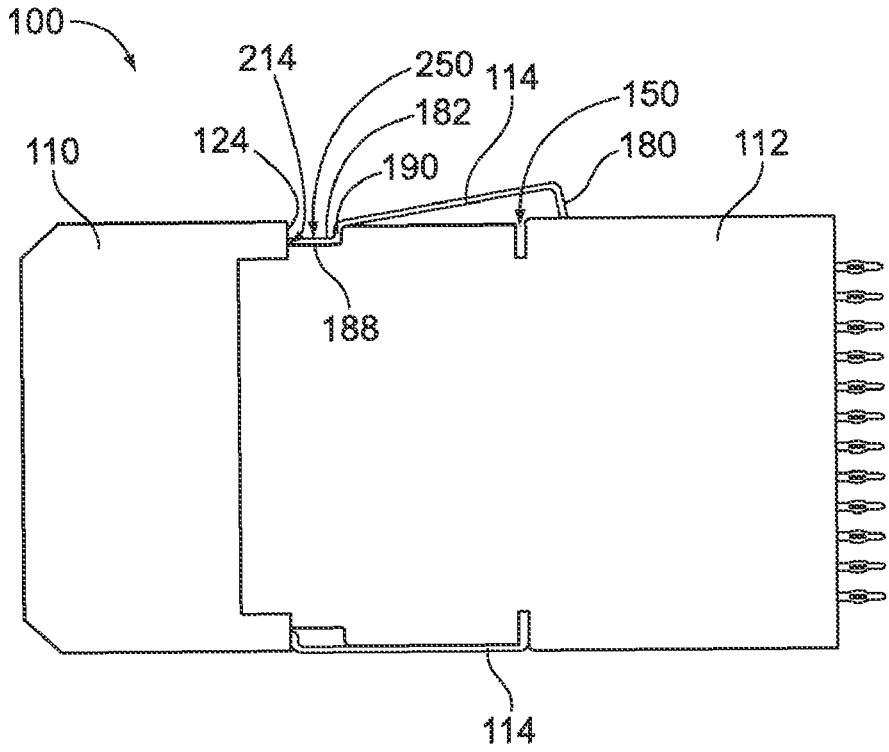
FIG. 6 illustrates the connector assembly during an initial stage of assembly in which the stabilizers are coupled to the housing and the contact modules.

FIG. 6 illustrates the connector assembly 100 during an initial stage of assembly in which the stabilizers 114 are coupled to the housing 110 and the contact modules 112. The lower stabilizer 114 is illustrated coupled to the housing 110 and the contact modules 112. The upper stabilizer 114 is illustrated in position with respect to the housing 110 and contact modules 112 for assembly thereto. The upper stabilizer 114 is in an initially loaded position with respect to the housing 110 and contact modules 112.

During assembly, the contact modules 112 are loaded through the rear 124 of the housing 110. A receiving space 250 is defined between the front shoulders 148 and the rear 124 of the housing 110. The receiving space 250 receives the bases 188 of the fingers 182. In the loaded position, the fingers 182 are positioned within the receiving space 250. The fingers 182 may be positioned within the receiving space 250 such that the legs 190 of the fingers 182 engage the front shoulders 148 of the contact modules 112. The fingers 182 are positioned within the receiving space 250 such that the fingers 182 are aligned with corresponding pockets 214. The gaps 202 (shown in FIG. 3) between the fingers 182 are aligned with the separating walls 216 (shown in FIG. 4).

When the stabilizer 114 is initially positioned with respect to the contact modules 112, the tabs 180 are not aligned with the grooves 150. Rather, the stabilizer 114 is in a retracted position. The tabs 180 are spaced apart from the fingers 182 by a distance that is greater than the distance between the front shoulders 148 and the grooves 150. In the retracted position, the tabs 180 are positioned rearward of the grooves 150. In the retracted position, the fingers 182 are positioned rearward of the pockets 214. Such positioning allows the stabilizer 114 to slide forwardly to an advanced position, in which the tabs 180 are aligned with the grooves 150, such as the position illustrated in FIG. 7. When the stabilizer 114 is slid forward to the advanced position, the fingers 182 are slid into the pockets 214. The stabilizer 114 may be slid forward in a direction parallel to the housing axis 120.

Figure 7:
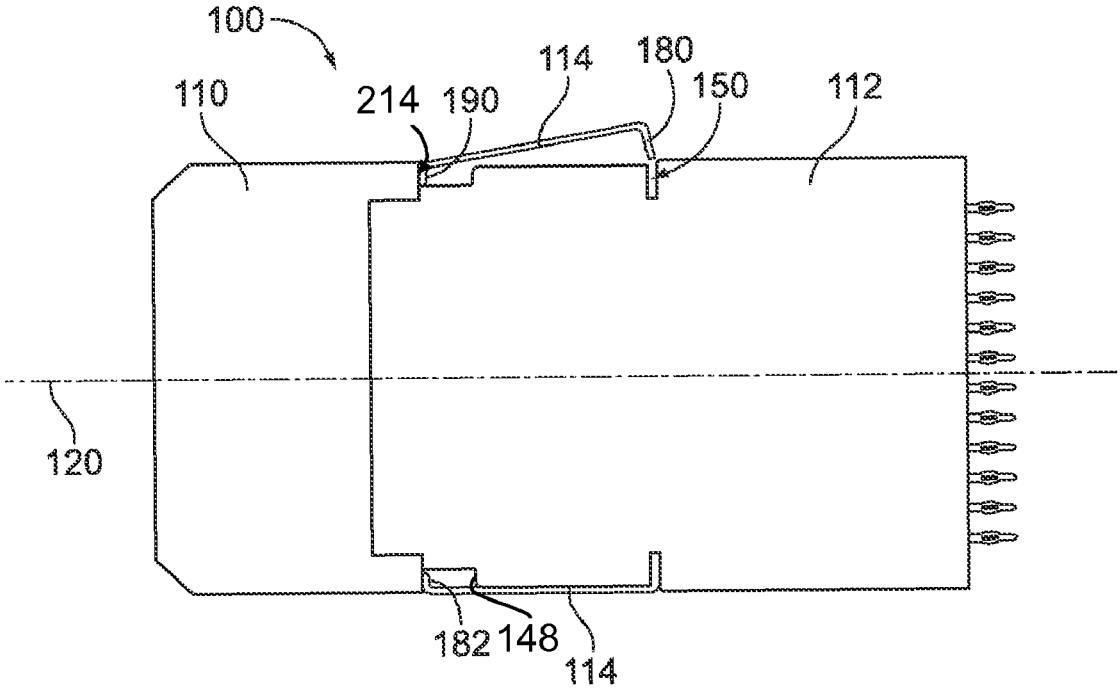
FIG. 7 illustrates the connector assembly during another stage of assembly with the stabilizer partially assembled.

FIG. 7 illustrates the connector assembly 100 during another stage of assembly, in which the upper stabilizer 114 is in an advanced position. The upper stabilizer 114 is illustrated in an unlocked position with respect to the contact modules 112. The lower stabilizer 114 is illustrated in an advanced and locked position, in which the stabilizer 114 is coupled to the housing 110 and the contact modules 112.

In the advanced position, the fingers 182 are received within the pockets 214. The leg 190 is moved forward away from the front shoulders 148. In the advanced position, the tabs 180 are aligned with the grooves 150. When the tabs 180 are held outside of the grooves 150, the stabilizer 114 is in an unlocked position. The stabilizer 114 is slidable with respect to the housing 110. As such, the fingers 182 may be slid into and out of the pockets 214. When the tabs 180 are loaded into the grooves 150, such as with the lower stabilizer 114, the stabilizer 114 is in a locked position. The stabilizer 114 is locked from moving in a forward direction or a rearward direction along the housing axis 120. In the locked position, the stabilizer 114 engages the contact modules 112. The stabilizer 114 holds the contact modules 112 relative to the housing 110. For example, the stabilizer 114 resists removal of the contact modules 112 from the housing 110 and/or resists removal of the housing 110 from the contact modules 112.

Returning to FIG. 1, which illustrates the upper and lower stabilizers 114 in the advanced and locked positions, the tabs 180 are received within the grooves 150. The interior tabs 180 are positioned between adjacent contact modules 112. The interior tabs 180 engage and hold the contact modules 112. The tabs 180 are separate from one another to allow relative movement between the tabs 180. As such, the tabs 180 can accommodate slight misalignment of adjacent contact modules 112. For example, when the contact modules 112 are loaded into the housing 110, the contact modules 112 may be loaded to different depths within an acceptable tolerance. The tabs 180 are configured to be fit within the grooves 150 of the misaligned adjacent contact modules 112.

The fingers 182 are slidably received within the pockets 214 of the housing 110. The fingers 182 may be variably positionable within the pockets 214 depending on the mating depth of the contact modules 112 and/or the overall lengths of the contact modules 112. For example, as noted above, the contact modules 112 may be loaded into the housing 110 to different loading depths within an acceptable tolerance. Depending on the loading depth, the bases 188 (shown in FIG. 3) of the fingers 182 may be either fully loaded into the pockets 214 or only partially loaded into the pockets 214. Furthermore, depending on a length of the bases 188 of the fingers 182, the stabilizer 114 may be used with contact modules 112 having different lengths. For example, the contact modules 112 may have different lengths between the grooves 150 and the front mating end 134 (shown in FIG. 2) of the contact modules 112, defining long contact modules and short contact modules. The same stabilizer 114 may be used with both the long contact modules and the short contact modules. A greater length of the fingers 182 may be received within the pockets 214 when used with the short contact modules, and a lesser length of the fingers 182 may be received within the pockets 214 when used with the long contact modules.

When the fingers 182 are received within the pockets 214, the stabilizer 114 is properly position with respect to the housing 110. For example, the front 172 of the plate 170 is oriented parallel to the rear 124 and perpendicular to the housing axis 120. Prior to loading the fingers 182 into the pockets 214, the stabilizer 114 may be angled such that the front 172 is nonparallel to the rear 124, such as due to the preload of the contact modules 112 within the housing 110, wherein the contact modules 112 are oriented at the skew angle 230. However, because the fingers 182 engage the housing 110 at multiple points (e.g. each finger 182 engaging one or both separating walls 216 defining the pockets 214), the orientation of the stabilizer 114 with respect to the housing 110 may be controlled. As such, when the stabilizers 114 are coupled to the housing 110 and to the contact modules 112, the contact modules 112 are properly oriented with respect to the housing 110. For example the contact modules 112 extend parallel to the housing axis 120.

In an alternative embodiment, rather than having the fingers slide into rear facing pockets, the fingers 182 may be shaped similar to the tabs 180 and extend perpendicularly downward from the from the plate 170. The fingers 182 may be received in upward or downward facing pockets from above or below the housing 110, similar to how the tabs 180 are received in the grooves 150.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing extending along a housing axis between a front and a rear;

contact modules loaded into the housing along the housing axis through the rear, each contact module having a body holding contacts arranged along contact planes, the contact modules having grooves formed therein; and a stabilizer coupled to the housing and coupled to the contact modules to hold the contact modules such that the contact planes are parallel to the housing axis, the stabilizer having tabs extending therefrom, the tabs being received in corresponding grooves with the tabs spanning across an interface between adjacent contact modules such that the tabs are received in grooves of both of the associated contact modules.

2. The connector assembly of claim 1, wherein the stabilizer engages the housing in at least two different points, such that a front of the stabilizer is oriented perpendicular to the housing axis.

3. The connector assembly of claim 1, wherein the housing includes pockets at the rear of the housing, the stabilizer being slidably coupled to the housing with the stabilizer sliding into the pockets when the stabilizer is coupled to the housing.

4. The connector assembly of claim 1, wherein the housing includes a chamber open at the rear that receives the contact modules, the housing includes an outer wall and pockets positioned between the chamber and the outer wall, the pockets being separated by separating walls therebetween, the stabilizer includes fingers extending therefrom, the fingers being received in corresponding pockets such that the fingers engage the separating walls to position the stabilizer with respect to the housing.

5. The connector assembly of claim 1, wherein the stabilizer includes a front and a rear, the tabs extending from the rear, the stabilizer having fingers extending from the front, the tabs engaging the contact modules, the fingers engaging the housing.

6. The connector assembly of claim 1, wherein the contact modules include a front shoulder, the groove positioned a distance from the front shoulder, the contact modules being loaded into the housing such that a receiving space is defined between the front shoulder and the rear of the housing, the stabilizer including a front and a rear with the tabs extending from the rear and fingers extending from the front, the tabs being spaced apart from the fingers by a distance greater than the distance between the front shoulders and the grooves, the fingers being initially received in the receiving space such that the tabs are misaligned with respect to the grooves, the stabilizer being slid forward such that the fingers are received in the housing until the tabs are aligned with the grooves, the tabs being received in the grooves to secure the stabilizer to the contact modules.

7. The connector assembly of claim 1, wherein the housing includes pockets at the rear of the housing, and wherein the stabilizer includes a front and a rear, the stabilizer having the tabs extending from the rear and fingers extending from the front, the fingers being slidably received within the pockets such that the fingers are variably positionable within the pockets based on a loaded position of the contact modules within the housing.

8. The connector assembly of claim 1, wherein the stabilizer includes a planar plate extending between a front and a rear, the stabilizer having the tabs extending perpendicular from the plate at the rear, the stabilizer having L-shaped fingers each having a base and a leg, the base extending perpendicular from the plate at the front, the leg extending forwardly from the base, the leg being slidably received within a pocket defined at a rear of the housing.

9. The connector assembly of claim 1, wherein the contact modules include a front mating end and a rear mounting end with sides extending therebetween, the contact modules having contact tips extending from the front mating end and contact tails extending from the rear mounting end, the contact modules being mated with the housing to define a vertical connector assembly configured to extend perpendicular with respect to the circuit board.

10. The connector assembly of claim 1, wherein the grooves have a front wall and a rear wall, the tabs being substantially planar and engaging the front and rear walls of corresponding grooves.

11. The connector assembly of claim 1, wherein the contact modules having top ends and bottom ends, the top ends aligned with one another, the bottom ends aligned with one another, the stabilizer comprises a first stabilizer, the connector assembly further comprising a second stabilizer, the first stabilizer extending along the top ends of the contact modules, the second stabilizer extending along the bottom ends of the contact modules, the second stabilizer coupled to the housing.

12. A connector assembly comprising:

a housing having a front and a rear, the housing having pockets open at the rear the pockets being enclosed by the housing;

contact modules loaded into the housing through the rear, portions of the contact modules extending rearward of the housing, the contact modules having a front mating end and a rear mounting end opposite the front mating end, the contact modules having opposite sides and opposite top and bottom ends extending between the front mating end and the rear mounting end, the contact modules being loaded into the housing such that the sides of adjacent contact modules face one another, the contact modules having contact tips extending from the front mating end and contact tails extending from the rear mounting end, the contact tips being loaded into the housing, the contact tails being configured to be mounted to a circuit board; and a stabilizer coupled to the housing and coupled to the contact modules to hold the contact modules relative to the housing, the stabilizer having an outer surface, the stabilizer having tabs engaging the contact modules, the stabilizer having fingers received in pockets of the housing, the outer surfaces of the fingers being covered by the housing.

13. The connector assembly of claim 12, wherein the stabilizer engages the housing in at least two different points, such that a front of the stabilizer is oriented perpendicular to the housing axis.

14. The connector assembly of claim 12, the stabilizer being slidably coupled to the housing with the stabilizer sliding into the pockets when the stabilizer is coupled to the housing.

15. The connector assembly of claim 12, wherein the housing includes a chamber open at the rear that receives the contact modules, the pockets being positioned outward of the chamber, the pockets being separated by separating walls therebetween, the fingers being received in corresponding pockets such that the fingers engage the separating walls to position the stabilizer with respect to the housing.

16. The connector assembly of claim 12, wherein the contact modules include a front shoulder and a groove positioned a distance from the front shoulder, the contact modules being loaded into the housing such that a receiving space is defined between the front shoulder and the rear of the housing, the stabilizer including a front and a rear with the tabs extending from the rear and the fingers extending from the front, the tabs being spaced apart from the fingers by a distance greater than the distance between the front shoulders and the grooves, the fingers being initially received in the receiving space such that the tabs are misaligned with respect to the grooves, the stabilizer being slid forward such that the fingers are received in housing until the tabs are aligned with the grooves, the tabs being received in the grooves to secure the stabilizer to the contact modules.

17. The connector assembly of claim 12, wherein the stabilizer includes a planar plate extending between a front and a rear, the tabs extending perpendicular from the plate at the rear, the tabs being received in grooves in the contact modules, the fingers being L-shaped having a base and a leg extending perpendicular with respect to the base, the base extending perpendicular from the plate at the front, the leg extending forwardly from the base, the leg being slidably received within a corresponding one of the pockets defined at the rear of the housing.

18. The connector assembly of claim 12, wherein the contact modules include grooves formed therein, the tabs being received in the grooves such that the tabs are positioned between adjacent contact modules, at least some of the tabs engaging two contact modules.

19. The connector assembly of claim 12, wherein the stabilizer comprises a first stabilizer, the connector assembly further comprising a second stabilizer, the first stabilizer extending along the top ends of the contact modules, the second stabilizer extending along the bottom ends of the contact modules, the second stabilizer having fingers received in pockets of the housing.

20. The connector assembly of claim 12, wherein the contact modules include grooves formed therein, the tabs being received in the grooves such that the tabs span across an interface between adjacent contact modules, at least some of the tabs engaging two contact modules.

* * * * *